US006108931A

United States Patent [19]

Schmidt et al.

[11] Patent Number: 6,108,931

[45] Date of Patent: Aug. 29, 2000

[54] CONTINUOUS DRYER FOR FLAT WORKPIECES

[75] Inventors: Manfred Schmidt, Oberaula-Olberode; Karl Maurer; Gerhard Lehn, both of Bad Hersfeld; Friedrich Bahner, Rotenburg/Fulda; Klaus Hentschel; Karl-Friedrich Lang, both of Bad Hersfeld, all of Germany

[73] Assignee: Babcock-BSH GmbH, Bad Hersfeld, Germany

[21] Appl. No.: 09/016,818

[22] Filed: Jan. 30, 1998

[30] Foreign Application Priority Data

Feb. 1, 1997 [DE] Germany ..... 297 01 755

[51] Int. Cl.[7] ..... F26B 19/00

[52] U.S. Cl. ..... 34/216; 34/231; 34/654

[58] Field of Search ..... 34/107, 216, 217, 34/218, 231, 654, 655, 656; 454/298, 324

[56] References Cited

U.S. PATENT DOCUMENTS 3,673,703 7/1972 Wieligmann ..... 34/216

5,351,416 10/1994 Witkin .

5,490,395 2/1996 Willaims et al. ..... 454/298

*Primary Examiner*—Henry Bennett

*Assistant Examiner*—Malik N. Drake

*Attorney, Agent, or Firm*—Herbert Dubno

[57] ABSTRACT

A drying apparatus has a housing, a conveyor for displacing a flat workpiece horizontally in a travel direction through the housing on a level, and a horizontal array of horizontally elongated upper nozzle boxes lying generally in a plane above the level. Each box is formed with a plurality of downwardly directed nozzle holes and heated air is fed to the boxes so it is projected from the holes against the workpiece for drying same. Respective upper shield plates each formed with a plurality of apertures are slidable on the respective boxes between a position with the apertures aligned with at least some of the respective holes and a position with the apertures out of line with the respective holes. At least one pivotal rod extending along a rod axis in the direction has radially projecting arms each engaged with a respective one of the respective shield plates. The rod can be pivoted about the rod axis to shift all the shield plates between their positions.

7 Claims, 7 Drawing Sheets

CONTINUOUS DRYER FOR FLAT WORKPIECES

FIELD OF THE INVENTION

The present invention relates to a drying apparatus. More particularly this invention concerns a continuous-throughput dryer for flat workpieces such as elongated plates or webs.

BACKGROUND OF THE INVENTION

A standard drying apparatus comprises a housing, a conveyor for displacing flat workpieces horizontally in a travel direction through the housing on respective vertically offset levels, a respective horizontal array of horizontally elongated upper nozzle boxes lying generally in a plane above each level and a respective horizontal array of horizontally elongated lower nozzle boxes lying generally in a plane below each level. Each lower box is formed with a plurality of upwardly directed nozzle holes and each upper box is formed with a plurality of downwardly directed nozzle holes. Heated air is fed to the boxes and projecting the heated air from the holes against the workpiece for drying same. Such a system is used, for instance, to dry freshly pressed gypsum-board panels to cure the binder therein and stiffen same. The air is recirculated inside the dryer as described in U.S. Pat. No. 5,351,416 of Witkin and German patent 843,386 of Krantz to avoid polluting the surroundings with any particles or gases picked up.

It is further known, for example from German utility model 1,871,618, German 1,196,516 of Sievers, German 1,460,672 of Mohring, German 1,596,520 of Carson (U.S. priority 604,006), German 2,029,494 of Hermann, German 4,412,071 of Honcamp, and German 4,331,496 of Baum to provide respective upper and lower shield plates each formed with a plurality of apertures and each slidable on a respective one of the boxes between a position with the apertures aligned with at least some of the respective holes and a position with the apertures out of line with the respective holes. This makes it possible to block some of the holes of the nozzle boxes to reduce the air flow therefrom when narrow workpieces, that is workpieces not wide enough to fill the press, are conveyed through the apparatus. This prevents heating capacity from being wasted.

The problem with these systems is that the changeover between wide and narrow workpieces is a laborious operation. The various shields must be shifted, normally one at a time, into the desired position. This not only entails opening the housing to gain access to the shield plates, but also requires each plate to be unclamped, shifted, and reclamped before the housing is closed up again. Changing workpieces on the fly is of course impossible, and in fact it is necessary to shut down the whole production line for a while on shifting between wide and narrow work pieces.

OBJECTS OF THE INVENTION

It is therefore an object of the present invention to provide an improved continuous dryer for flat workpieces.

Another object is the provision of such an improved continuous dryer for flat workpieces which overcomes the above-given disadvantages, that is which can simply and easily be converted when changing workpiece width.

SUMMARY OF THE INVENTION

A drying apparatus has according to the invention a housing, a conveyor for displacing a flat workpiece horizontally in a travel direction through the housing on a level, and a horizontal array of horizontally elongated upper nozzle boxes lying generally in a plane above the level. Each box is formed with a plurality of downwardly directed nozzle holes and heated air is fed to the boxes so it is projected from the holes against the workpiece for drying same. Respective upper shield plates each formed with a plurality of apertures are slidable on the respective boxes between a position with the apertures aligned with at least some of the respective holes and a position with the apertures out of line with the respective holes. At least one pivotal rod extending along a rod axis in the direction has radially projecting arms each engaged with a respective one of the respective shield plates. The rod can be pivoted about the rod axis to shift all the shield plates between their positions.

In accordance with the invention a horizontal array of horizontally elongated lower nozzle boxes lies generally in a plane below each level and each lower box is formed with a plurality of upwardly directed nozzle holes. Respective lower shield plates each formed with a plurality of apertures are slidable on the respective lower boxes between a position with the apertures aligned with at least some of the respective holes and a position with the apertures out of line with the respective holes. The rod has radially projecting second arms separate from the first-mentioned arms and each engaged with a respective one of the lower shield plates. Thus even these lower shield plates are shifted synchronously with the upper shield plates.

With this system, therefore, it is possible from a single location, which, according to the invention, is outside the dryer housing, to reset the positions of the shield plates. This can be done very quickly and can even be done while the dryer is in operation. Thus on change of workpiece width the dryer can be adjusted without shutting down the production line and this can even be done to adjust drying during use.

The conveyor according to the invention defines a plurality of vertically spaced such levels each flanked by a respective array of such upper boxes and by a respective array of such lower boxes. The means for pivoting includes a radially projecting actuating arm on the rod, a vertically displaceable upright element coupled to the actuating arm, and means for vertically displacing the element.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
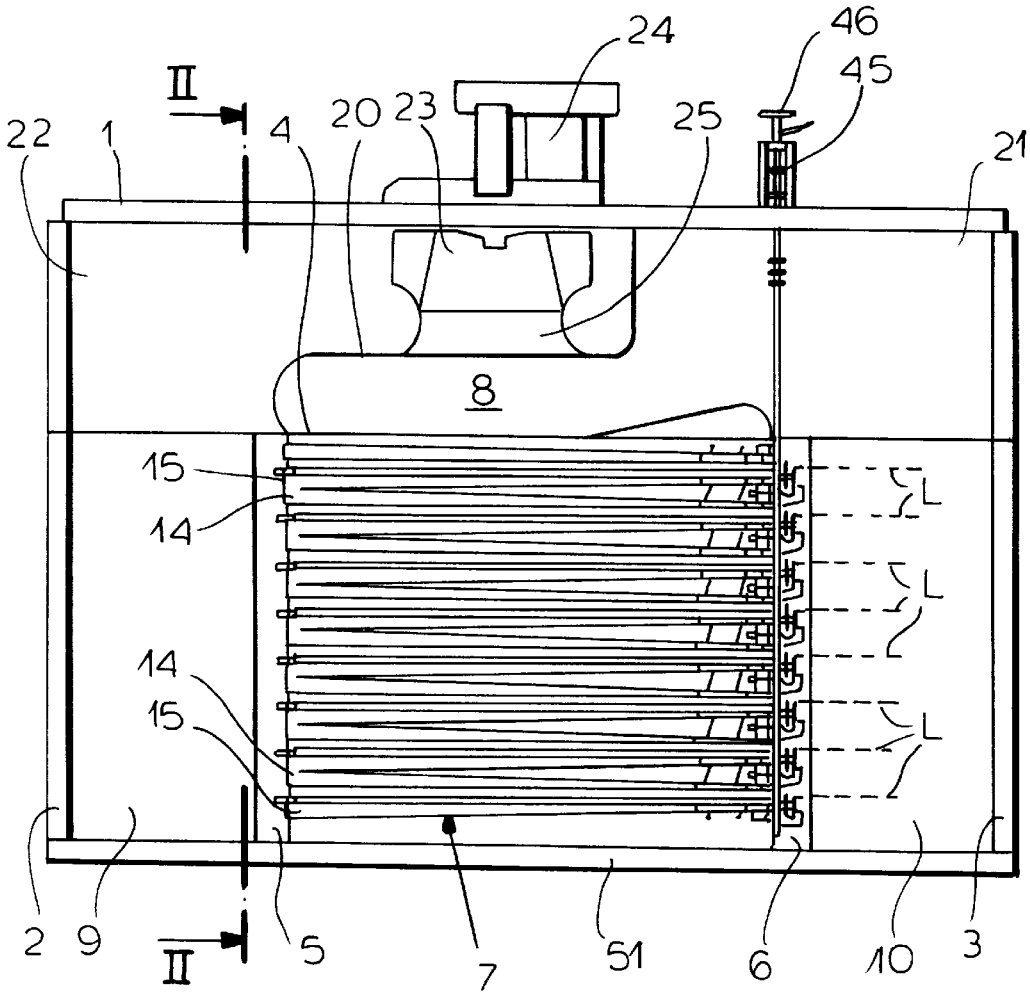
FIG. 1 is a vertical cross section through the apparatus according to the invention.
Figure 2:
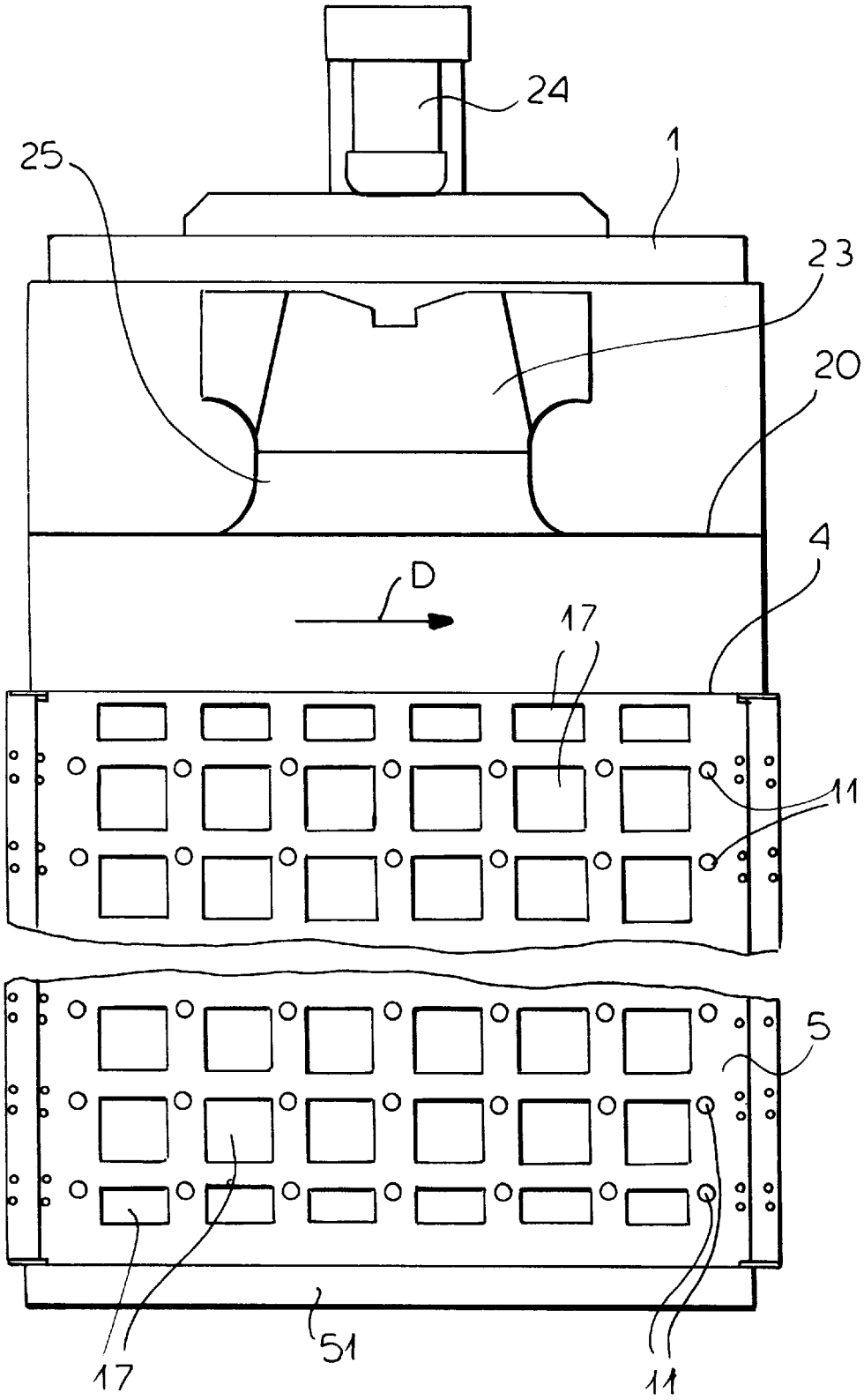
FIG. 2 is a longitudinal section taken along line II—II of FIG. 1.

As seen in FIGS. 1 and 2 a dryer according to the invention has a horizontal top wall 1, a horizontal bottom wall 51, and a pair of vertical side walls 2 and 3 defining a horizontally throughgoing tunnel having an overall length of 2.0 m to 2.5 m parallel to a horizontal travel direction D of workpieces 50 (FIG. 3), here gypsum-board panels, through the drier and a horizontal width of 5.0 m to 6.0 m. Internally the dryer has extending in the direction D a horizontal partition 4, a vertical partition 5 extending from the floor 51 up to the partition 4, and a frame 6 extending parallel to but spaced transversely from the partition 5. The partition 5 and frame 6 delimit a central core space 7 that extends over from 50% to 65% of the overall width of the machine and over from 60% to 80% of the overall height of the device. The partition 5 defines with the side wall 2 an upright input compartment 9 and the frame 6 defines with the side wall 3 on the opposite side of the space 7 a vertical output compartment 10. The partition 4 defines with the roof or top wall 1 a chamber 8 subdivided by a further partition 20 into an output compartment 22 connected to the compartment 9 and an intake compartment 21 connected to the vertical cutout compartment 10. An axial-input radial-output impeller 23 driven by a motor 24 atop the wall 1 sucks heated air in through a collar 25 from the space 7 and expels this air into the compartment 22.

The core space 7 is subdivided into eight to twelve levels L each between 250 mm and 350 mm high by horizontal arrays of rollers 11 journaled in the partition 5 and frame 16 and each having an end pin 12 carrying a sprocket 13. Unillustrated chains engaged over the sprockets 13 rotate all the rollers 11 in the same direction to convey the workpieces 50 horizontally through the dryer in the direction D.

Figure 3:
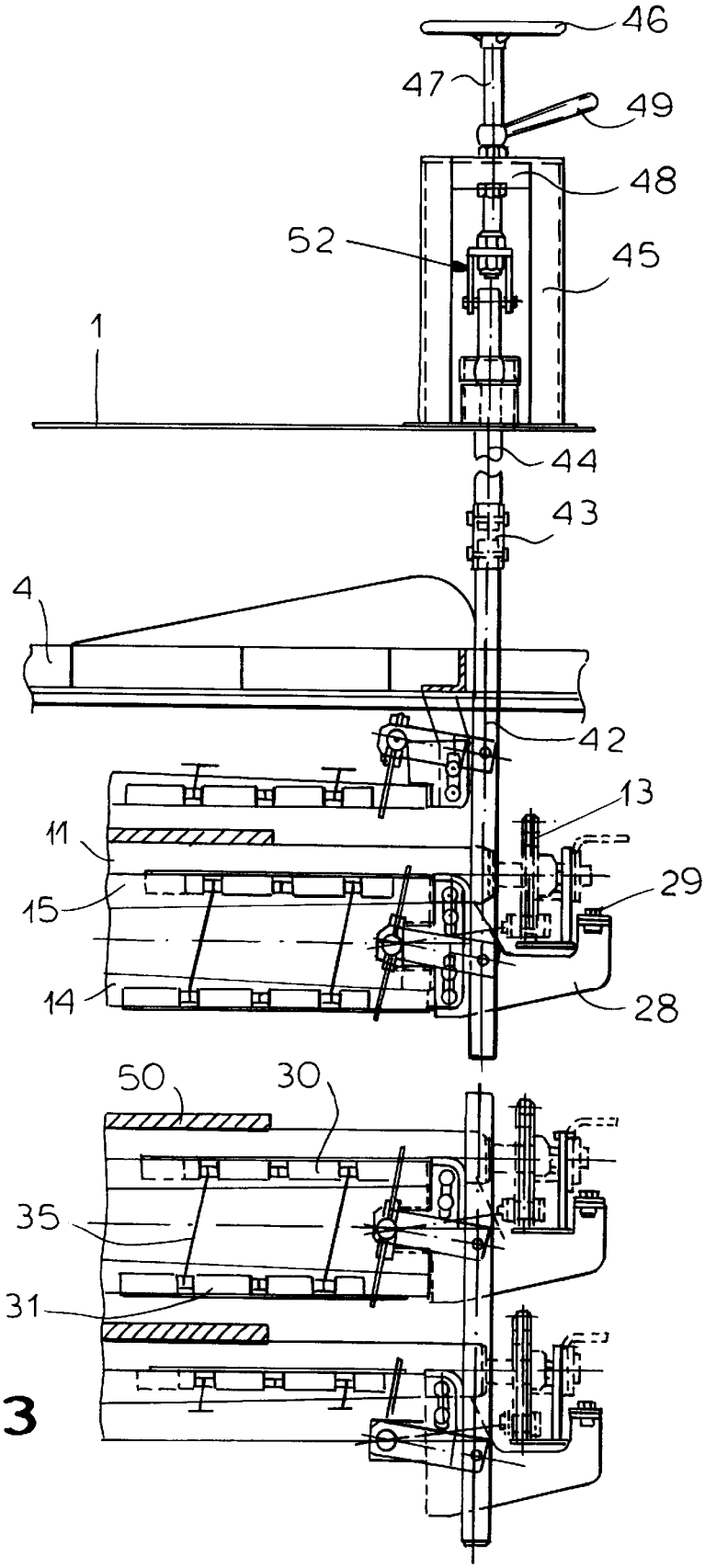
FIG. 3 is a larger-scale view of a detail of FIG. 1.
Figure 5:
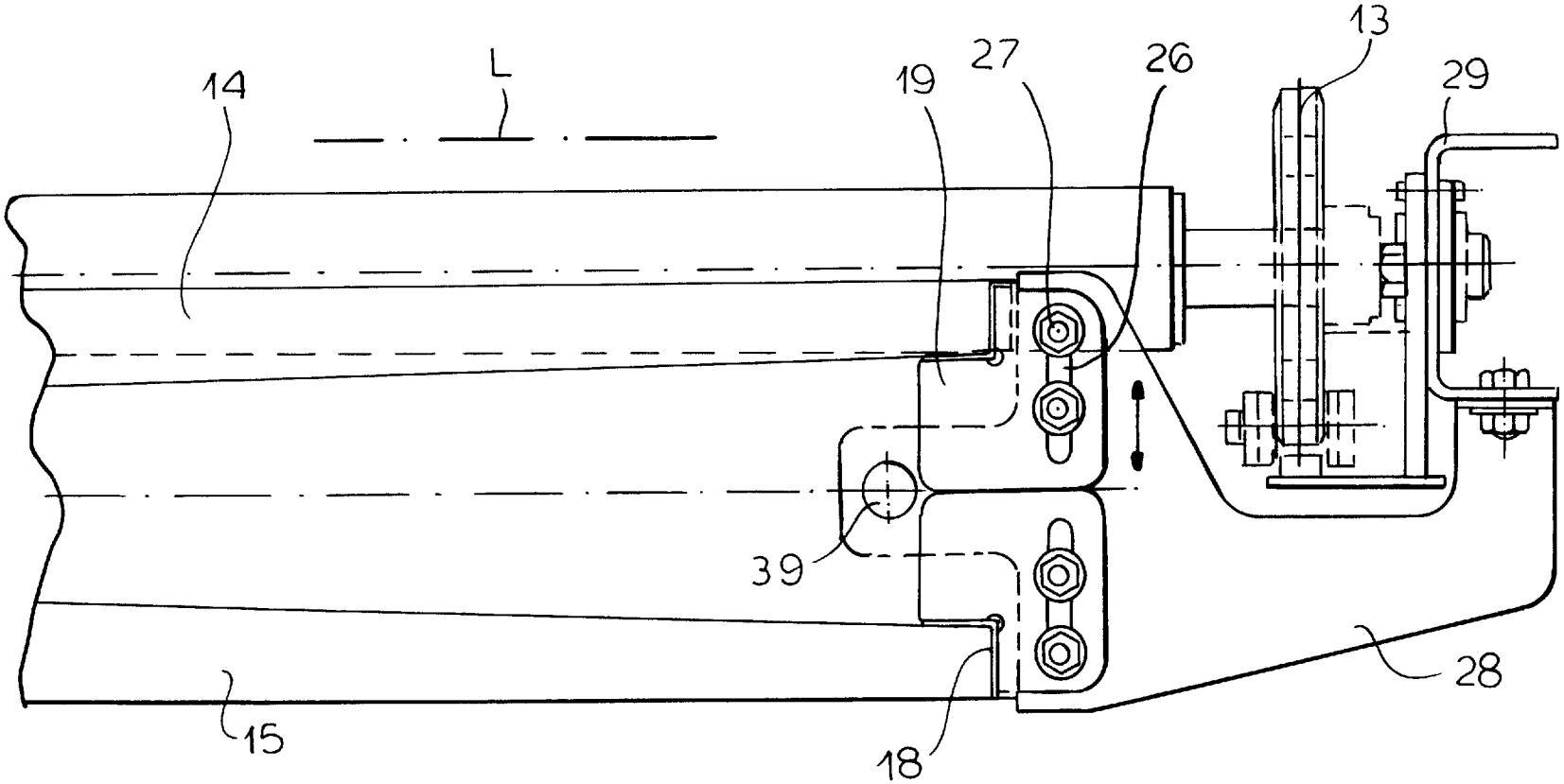
FIG. 5 is a view like FIG. 4 but with some parts removed for clarity of view.

As better shown in FIG. 3, associated with each of the levels L defined by the arrays of rollers 11 is an array of upper nozzle boxes 14 and a similar array of lower nozzle boxes 15. Lower faces of the upper boxes 14 and upper faces of the lower boxes 15 are formed with arrays of throughgoing holes 16 directed at the respective workpieces 50 supported on the respective arrays of rollers 11. Each box 14 and 15 is tapered and has one large end fixed to the partition 5 at an inlet hole 17 which it may share with another such box and an opposite small end closed by an end plate 18 shown in FIG. 5 and fixed to a support plate 19. Each such plate 19 is formed with a vertical slot 26 through which pass two screws 27 that in turn fix the plate 19 to a U-shaped mounting plate 28 itself fixed at 29 to the rack 6. Loosening of the screws 27 allows the vertical positions of the boxes 14 and 15 to be adjusted.

With this system, therefore, the blower 23 pressurizes the compartment 9 and thus forces heated air through the openings 17 into the boxes 14 and 15. This air blows out through the holes 16 and impinges on the workpieces 50 passing through in the direction D and dries them.

Figure 4:
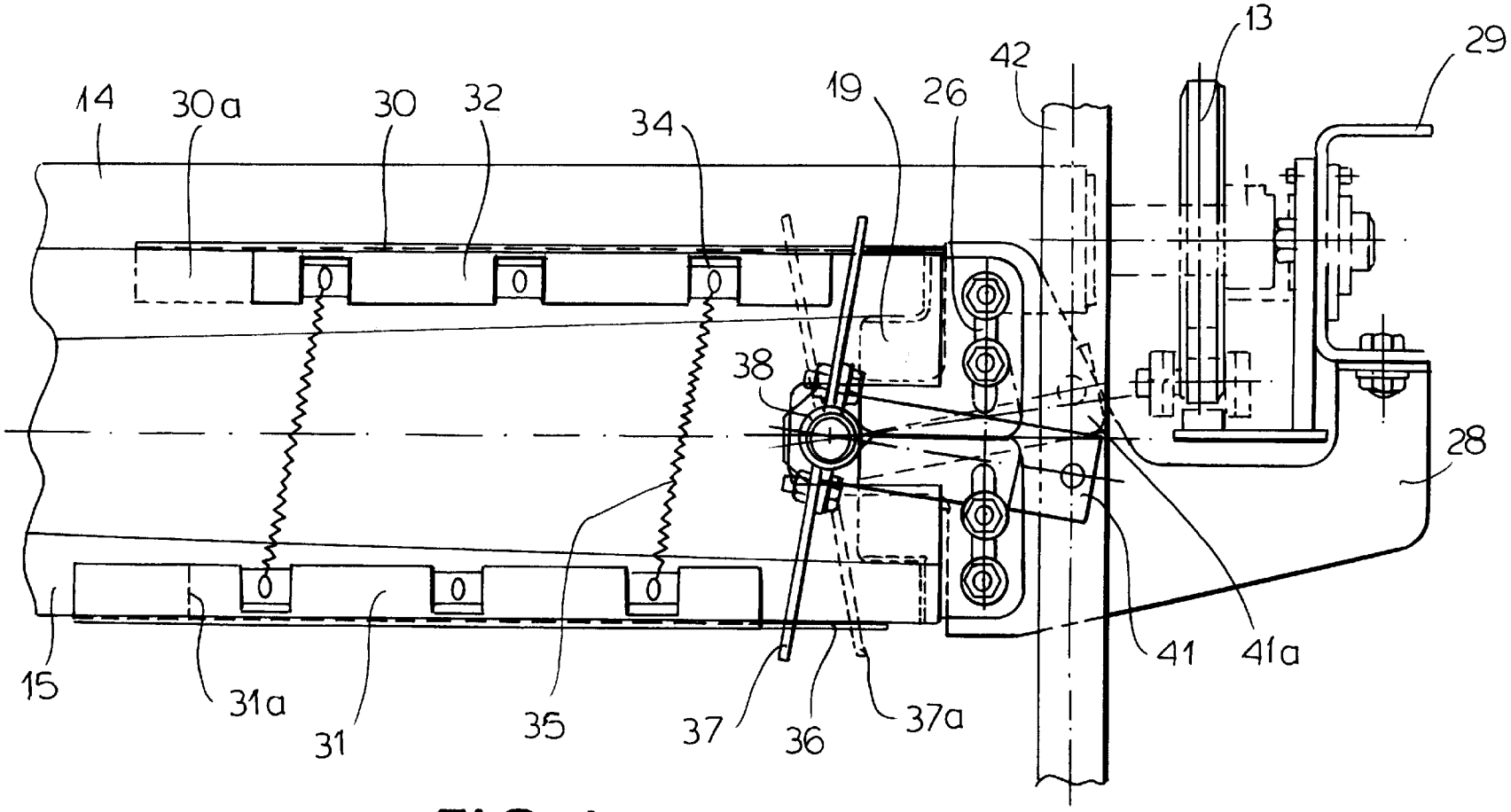
FIG. 4 is a larger-scale view of a detail of FIG. 3.
Figure 6:
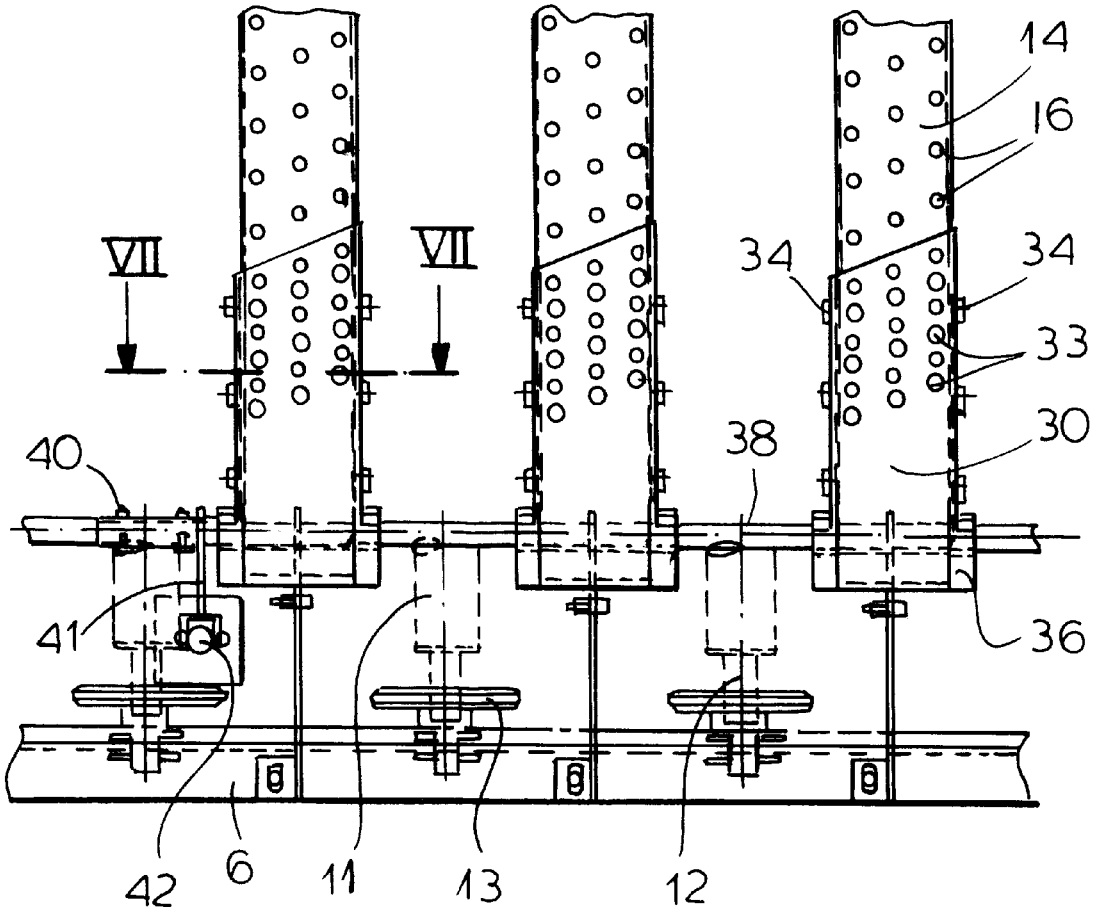
FIG. 6 is a large-scale top view of the structure of FIG. 4.
Figure 7:
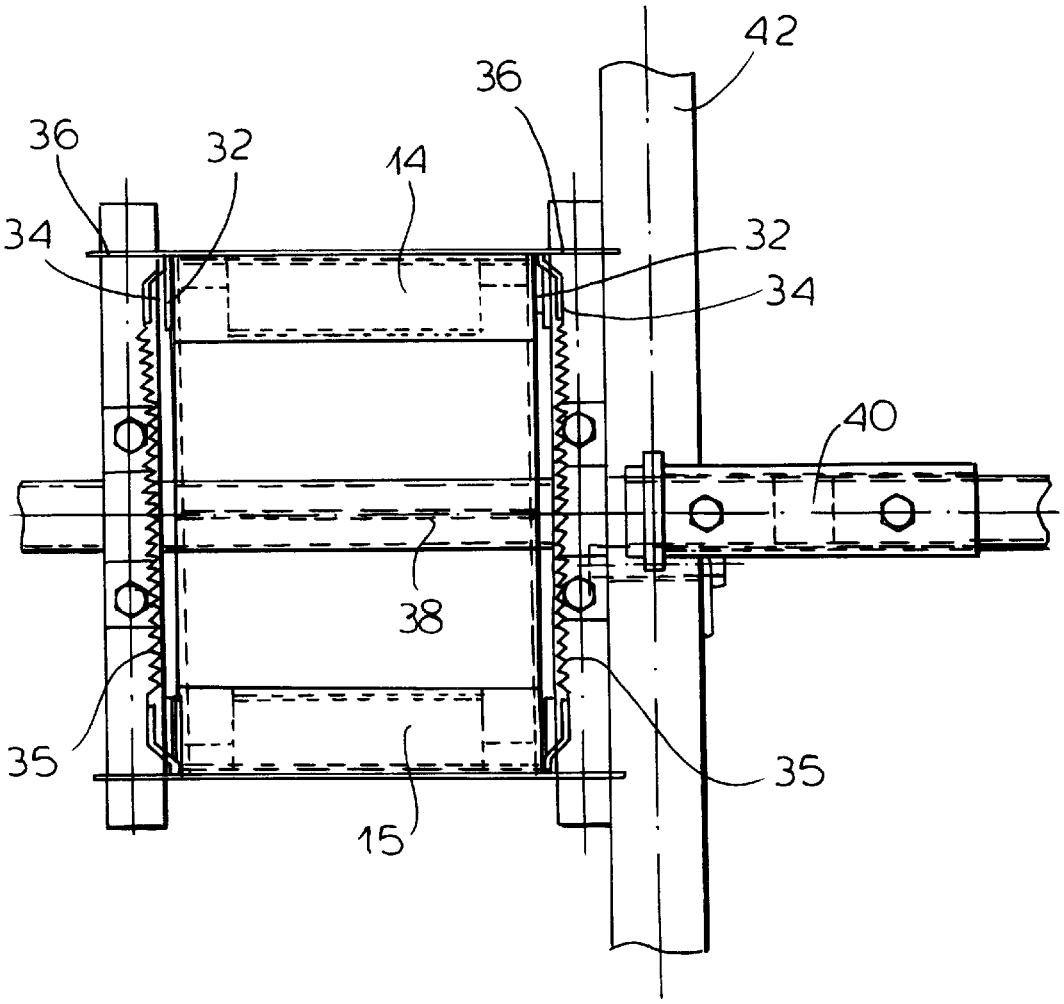
FIG. 7 is a section taken along line VII—VII of FIG. 6.

According to the invention each lower box 14 is fitted with a shield plate or slider 30 and each upper box with a similar such shield plate or slider 31. The plates 30 and 31 are each formed with transversely bent side flaps 32 as shown in FIGS. 4 and 7 and as shown in FIG. 6 are each formed with an array of circular holes 33 of a diameter equal to about twice that of the respective holes 16 in the respective box 14 or 15. The holes 33 can be arrayed the same as the holes 16 or differently so that in different positions of the slider plates 30 and 31 on the boxes 14 and 15 different ones of the holes 16 are exposed. The plates 30 and 31 have a length equal to between 10% and 20% of the maximum possible workpiece width, that is the roller length. Each side flap 32 is formed with a plurality of eyes 34 and a tension spring 35 is connected between each of the eyes 34 of each lower box 14 and the respective eyes 34 of the underlying upper box 15 so as to hold the shield plates 30 and 31 snugly in place on the respective boxes 14 and 15.

Extending in the direction D midway between the levels L and adjacent the rack 6 are rods 38 to which are fixed a plurality of two-arm levers 37 each of whose upper arms passes through a hole in a respective end 36 of a respective lower plate 30 and each of whose lower arms extends through a similar such hole in an end 36 of a respective upper plate 31. The rods 38 are journaled in holes 39 (FIG. 5) formed in the support plates 28 and can be connected together as shown in FIG. 6 in the direction D via couplings 40 to adjacent such rods 38 of adjacent such dryers. Each rod 38 carries a radially extending arm 41 pivoted on a vertical rod 42 connected as shown in FIG. 3 by a coupling 43 to another rod 44 itself connected via a coupling 52 to a threaded spindle 47 threaded in a plate 48 of a mount 45 secured to the roof 1. A hand wheel 46 allows the threaded spindle 47 to be rotated and thereby raise or lower the rod 42 to change the angular position of all of the levers 37 and thereby shift the shield plates 30 and 31 on the boxes 14 and 16. A lock-nut handle 49 on the spindle 47 allows the setting to be fixed.

Thus from a single location it is possible to shift all of the shield plates 30 and 31 in the dryer, pushing them in to block the holes 16 or pulling them back to expose them. Thus changeover from wide to narrow workpieces 50 can be done very easily, even while the machine is operating.

We claim:

1. A drying apparatus comprising:

a housing;

a conveyor for displacing a flat workpiece horizontally in a travel direction through the housing on a level;

a horizontal array of horizontally elongated upper nozzle boxes lying in a plane above the level, each box being formed with a plurality of downwardly directed nozzle holes;

means for feeding heated air to the boxes and projecting the heated air from the holes against the workpiece for drying same;

respective upper shield plates each formed with a plurality of apertures and slidable in a shield-plate plane on the respective boxes between a position with the apertures aligned with at least some of the respective holes and a position with the apertures out of line with the respective holes;

at least one pivotal rod lying in a plane parallel to said shield-plate plane extending along a rod axis in the direction and having radially projecting arms each engaged with a respective one of the respective shield plates; and means for pivoting the rod about the rod axis and thereby shifting all the shield plates between their positions.

2. A drying apparatus comprising:

a housing;

a conveyor for displacing a flat workpiece horizontally in a travel direction through the housing on a level;

a horizontal array of horizontally elongated upper nozzle boxes lying in a plane above the level, each box being formed with a plurality of downwardly directed nozzle holes;

means for feeding heated air to the boxes and projecting the heated air from the holes against the workpiece for drying same;

respective upper shield plates each formed with a plurality of apertures and slidable on the respective boxes between a position with the apertures aligned with at least some of the respective holes and a position with the apertures out of line with the respective holes;

at least one pivotal rod extending along a rod axis in the direction and having radially projecting arms each engaged with a respective one of the respective shield plates, means for pivoting the rod about the rod axis and thereby shifting all the shield plates between their positions;

a horizontal array of horizontally elongated lower nozzle boxes lying generally in a plane below the level, each lower box being formed with a plurality of upwardly directed nozzle holes; and respective lower shield plates each formed with a plurality of apertures and slidable on the respective lower boxes between a position with the apertures aligned with at least some of the respective holes and a position with the apertures out of line with the respective holes, the rod having radially projecting second arms separate from the first-mentioned arms and each engaged with a respective one of the lower shield plates.

3. The drying apparatus defined in claim 2 wherein the conveyor defines a plurality of vertically spaced such levels each flanked by a respective array of such upper boxes and by a respective array of such lower boxes.

4. The drying apparatus defined in claim 2 wherein the means for pivoting includes a radially projecting actuating arm on the rod, a vertically displaceable upright element coupled to the actuating arm, and means for vertically displacing the element.

5. The drying apparatus defined in claim 4 wherein the means for vertically displacing the element is outside the housing.

6. A drying apparatus comprising:

a housing;

a conveyor for displacing flat workpieces horizontally in a travel direction through the housing on respective vertically offset levels;

a respective horizontal array of horizontally elongated upper nozzle boxes lying generally in a plane above each level, each upper box being formed with a plurality of downwardly directed nozzle holes;

a respective horizontal array of horizontally elongated lower nozzle boxes lying generally in a plane below each level, each lower box being formed with a plurality of upwardly directed nozzle holes;

means for feeding heated air to the boxes and projecting the heated air from the holes against the workpiece for drying same;

respective upper and lower shield plates each formed with a plurality of apertures and each slidable on a respective one of the boxes between a position with the apertures aligned with at least some of the respective holes and a position with the apertures out of line with the respective holes;

a plurality of respective pivotal rods extending along a rod axis in the direction between the levels and each having a radially projecting upper arms engaged with a respective one of the respective lower shield plates and a radially oppositely projecting lower arm engaged with a respective one of the respective upper shield plates; and means for pivoting the rod about the rod axis and thereby shifting all the shield plates between their positions.

7. The drying apparatus defined in claim 6 wherein each rod has a radially projecting actuating arm, the means for pivoting including an upright element coupled to all the actuating arms, and means for vertically displacing the element and thereby synchronously displacing all the shield plates between their positions.

* * * * *